US010745995B2

(12) United States Patent
Bhadbhade et al.

(10) Patent No.: US 10,745,995 B2
(45) Date of Patent: Aug. 18, 2020

(54) FLUID TOLERANT SUBSEA MANIFOLD SYSTEM

(71) Applicant: ONESUBSEA IP UK LIMITED, London (GB)

(72) Inventors: Tej Bhadbhade, Houston, TX (US); Ahmed Zeouita, Sugar Land, TX (US); Adam Tusing, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/783,396

(22) Filed: Oct. 13, 2017

(65) Prior Publication Data

US 2019/0112893 A1 Apr. 18, 2019

(51) Int. Cl.

| | |
|---|---|
| ***E21B 34/04*** | (2006.01) |
| ***E21B 33/035*** | (2006.01) |
| ***E21B 33/064*** | (2006.01) |
| ***E21B 43/013*** | (2006.01) |
| *E21B 33/076* | (2006.01) |

(52) U.S. Cl.

CPC ..... *E21B 34/04* (2013.01); *E21B 33/0355* (2013.01); *E21B 33/064* (2013.01); *E21B 34/045* (2013.01); *E21B 43/013* (2013.01); *E21B 33/076* (2013.01)

(58) Field of Classification Search

CPC ..... E21B 34/04; E21B 33/064; E21B 43/013; E21B 33/076

See application file for complete search history.

(56) References Cited

U.S. PATENT DOCUMENTS 3,219,118 A * 11/1965 Lewis ..... E21B 33/0355 166/351
3,496,999 A * 2/1970 Rowley ..... E21B 33/0355 166/363
4,375,239 A * 3/1983 Barrington ..... E21B 17/003 166/336

(Continued)

FOREIGN PATENT DOCUMENTS

| | | | |
|---|---|---|---|
| GB | 2191804 | A | 12/1987 |
| WO | 0008297 | A1 | 2/2000 |
| WO | 2016100680 | A1 | 6/2016 |

OTHER PUBLICATIONS

Search and Examination Report R. 62 issued in European Patent Application 18199922.8 dated Mar. 7, 2019, 7 pages.

*Primary Examiner* — Matthew R Buck
*Assistant Examiner* — Aaron L Lembo
(74) *Attorney, Agent, or Firm* — Helene Raybaud

(57) ABSTRACT

A technique which enables construction and operation of a subsea landing string system having a system manifold or manifolds unprotected by a dielectric fluid compensated enclosure. The manifolds contain directional control valves and corresponding solenoids which are able to operate while being exposed to environmental fluids such as seawater. The ability to operate manifolds in an unprotected environment enables the manifolds to be positioned in a variety of locations along the subsea landing string system or in cooperation with the subsea landing string system. The subsea landing string system also may be a modular system in which manifolds are added or removed according to the parameters of a given operation.

20 Claims, 15 Drawing Sheets

(56) References Cited

U.S. PATENT DOCUMENTS

| | | | | |
|---|---|---|---|---|
| 5,070,904 | A * | 12/1991 | McMahon, Jr. | E21B 33/0355 137/1 |
| 5,916,464 | A * | 6/1999 | Geiger | B23K 9/1336 219/130.4 |
| 7,112,080 | B2 * | 9/2006 | Nicholson | E21B 17/023 439/283 |
| 8,490,705 | B2 * | 7/2013 | Curtiss, III | E21B 34/16 166/250.1 |
| 8,517,112 | B2 | 8/2013 | Niemeyer et al. | |
| 8,725,302 | B2 | 5/2014 | Niemeyer et al. | |
| 8,839,868 | B2 * | 9/2014 | Scranton | E21B 34/045 166/360 |
| 9,528,340 | B2 * | 12/2016 | Beales | E21B 33/064 |
| 9,631,448 | B1 | 4/2017 | Rytlewski | |
| 2011/0005770 | A1 | 1/2011 | Scranton et al. | |
| 2013/0092385 | A1 * | 4/2013 | Curtiss, III | E21B 34/16 166/336 |
| 2016/0109874 | A1 * | 4/2016 | Holmes | G05B 19/406 700/275 |
| 2016/0177654 | A1 * | 6/2016 | Beales | E21B 33/064 251/1.1 |
| 2016/0329697 | A1 * | 11/2016 | Brooks | H01F 7/064 |
| 2018/0073320 | A1 * | 3/2018 | Holmes | E21B 33/064 |
| 2018/0179847 | A1 * | 6/2018 | Derryberry | E21B 33/0355 |

* cited by examiner

FLUID TOLERANT SUBSEA MANIFOLD SYSTEM

BACKGROUND

In subsea operations, hydrocarbon fluids such as oil and natural gas are obtained from a subterranean geologic formation, referred to as a reservoir, by drilling a well that penetrates the hydrocarbon-bearing geologic formation. Subsea equipment is positioned at the well and may comprise a wellhead and a blowout preventer. A riser may be deployed between the subsea equipment and a surface facility, e.g. a surface vessel. A subsea landing string system may be deployed down through the riser and into the subsea equipment to provide hydraulic controls over various tools and safety features. For example, the subsea landing string system may comprise a subsea control module which actuates directional control valves based on control signals sent from the surface.

The directional control valves are part of an electro-hydraulic system and may be solenoid piloted according to control signals. Based on the control signals, the directional control valves are actuated so as to direct hydraulic actuating fluid to appropriate tools or other features. The solenoids and directional control valves are housed in manifolds mounted inside a dielectric fluid compensated enclosure to prevent exposure to seawater which can cause shorting of the solenoids. Due to the compensated enclosure, large compensators are used which tends to make the overall subsea landing string system larger in size. The compensated enclosure also prevents direct access to the directional control valves which increases the difficulty of servicing and troubleshooting the subsea landing string system. Additionally, the dielectric fluid compensated enclosure and corresponding compensators are vacuum filled which can increase the time involved with both assembly and service of the subsea landing string system.

SUMMARY

In general, a system and methodology are provided which enable construction and operation of a subsea landing string system having a system manifold or manifolds unprotected by a dielectric fluid compensated enclosure. The manifolds contain directional control valves and corresponding solenoids which are able to operate while being exposed to environmental fluids such as seawater. The ability to operate manifolds in an unprotected environment enables the manifolds to be positioned in a variety of locations along the subsea landing string system or in cooperation with the subsea landing string system. The subsea landing string system may be a modular system in which manifolds are added, removed or adjusted according to the parameters of a given operation. The system modularity can greatly reduce tool downtime and provide greater flexibility to meeting changing client needs.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
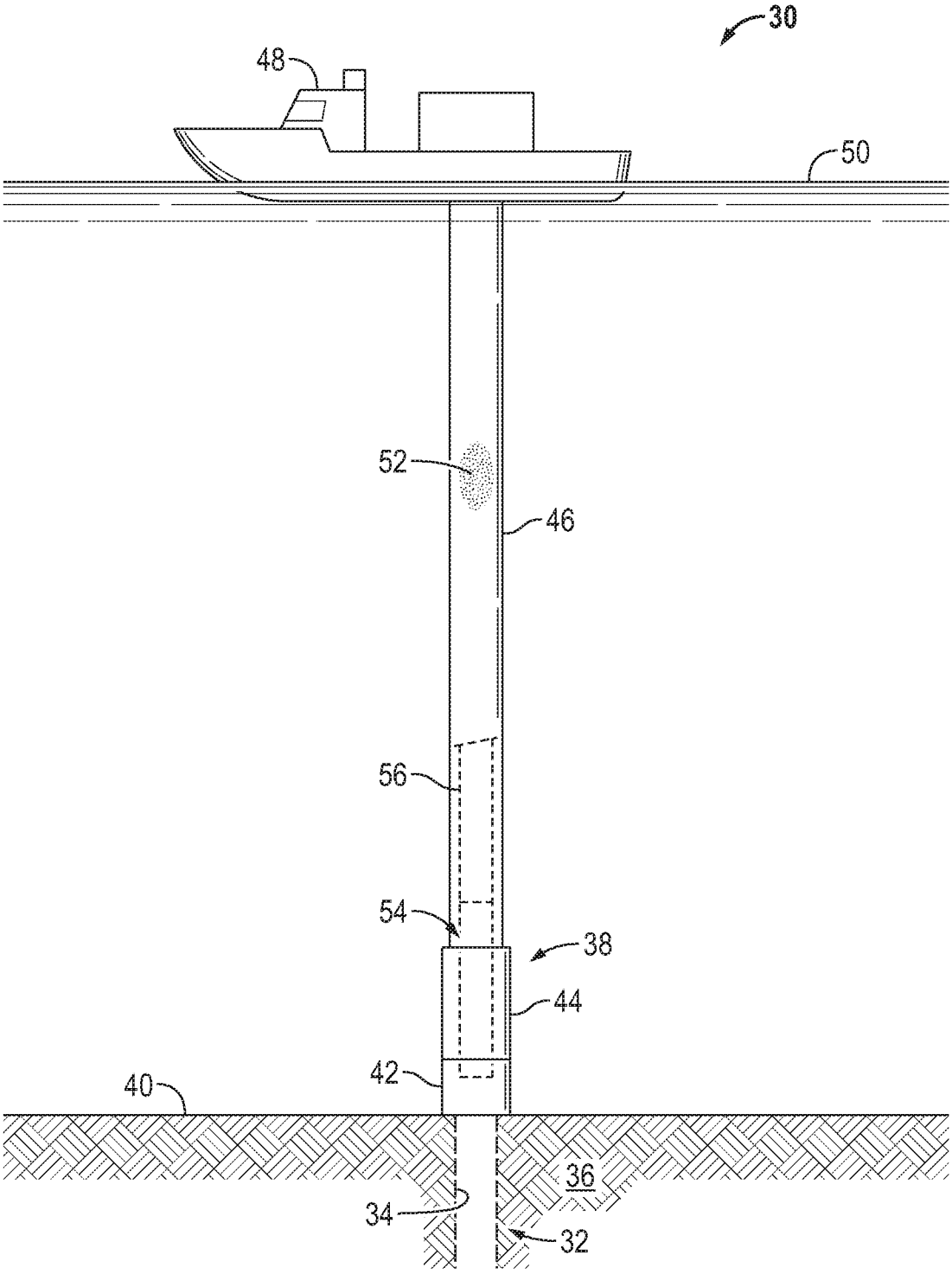
FIG. 1 is a schematic illustration of an example of a subsea well system having a subsea landing string system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate construction and operation of a subsea landing string system having a ruggedized system manifold or manifolds. According to embodiments, the ruggedized manifold system is unprotected by a dielectric fluid compensated enclosure. The approach enables use of the subsea landing string system while the manifolds are exposed to seawater or other environmental fluids, such as fluids contained within a riser. Because the manifolds are not sealed within a compensated enclosure containing dielectric fluid, the overall structure of the subsea landing string system may be modular. In other words, the subsea landing string system may be constructed with manifold attachment regions which allow manifolds to be added and removed according to the parameters of a given operation.

In some embodiments, the subsea landing string system may be constructed such that sections of the landing string and corresponding manifolds may be added, removed or adjusted, effectively making the system larger or smaller as desired. Because the manifolds may be exposed to surrounding environmental fluids, the modular system is enabled and may be modified as desired for each job. The system modularity can greatly reduce tool downtime in various applications. For example, the modularity enables greater accessibility which results in easier maintenance and troubleshooting. The greater accessibility also allows the system to be easily modified between jobs to comply changing client needs of a specific job. The manifolds may have valves, control board, sensors, wiring schemes, communication architecture, and/or other features which help achieve a desired modularity.

According to an embodiment, the manifolds contain directional control valves and corresponding solenoids which are able to operate while being exposed to environmental fluids such as seawater. The ability to operate manifolds in an unprotected environment enables the manifolds to be positioned in a variety of locations along the subsea landing string system. Depending on parameters of a given subsea operation, the manifolds may be positioned separate from the landing string and used in cooperation with the subsea landing string system.

In some embodiments, each manifold may contain or work in cooperation with a manifold electronic module, e.g. an electronics board, and may also contain sensors, e.g. pressure gauges. The manifolds can be completely self contained hydraulic control and monitoring packages. Wiring and electrical terminations may be protected from environmental fluid, e.g. external riser fluid, by various approaches. The electronic board associated with each manifold provides signals/commands to actuate the solenoids which, in turn, actuate the corresponding directional control valves. A separate subsea electronic module (SEM) may be operatively coupled with the electronic boards to provide commands to the individual electronic boards for each manifold.

The electrical architecture may be constructed according to various methodologies such as a multidrop architecture in which multiple nodes are connected on the same bus. Such an approach enables connection of the manifolds via daisy-chaining techniques or other suitable techniques. This technique significantly reduces the number of electrical connections thereby significantly increasing the overall reliability of the system.

The modularity of the subsea landing string system enables functional expansion of the system without loss of system reliability. Additionally, the modularity enables changes between jobs to meet the parameters for a given operation. For example, the types of manifolds may be changed, e.g. high pressure rated manifolds may be substituted for low pressure rated manifolds or manifolds with different directional control valves may be added or substituted. The overall system is simpler and less expensive due to the ability to provide manifolds which are not sealed within a compensated dielectric chamber.

Additionally, the modularity provides a system which is easier to service, thus reducing service downtime. The modularity also enables manifolds to be located on other assets or at other positions in the overall landing string instead of being restricted to the subsea landing string system. Furthermore, the approach facilitates more rapid and precise control of, for example, a subsea test tree and associate valves while also enabling a quicker emergency shutdown.

Referring generally to FIG. 1, an example of a subsea system 30 is illustrated. The illustrated embodiment of subsea system 30 may be used in many types of subsea well applications, e.g. subsea hydrocarbon production operations and/or injection operations. Depending on the parameters of a given subsea operation, the subsea system 30 may comprise a variety of different types of components.

By way of example, the subsea system 30 may comprise at least one well 32 having a wellbore 34 extending into a subsea geologic formation 36. An upper end of the wellbore 34 is in fluid communication with a wellhead installation 38 positioned proximate a sea floor 40. The wellhead installation 38 may comprise various types of equipment, such as a wellhead system 42 (which may include a Christmas tree) and a blowout preventer 44 positioned above the wellhead system 42.

In the example illustrated, a riser 46 extends between the wellhead installation 38 and a surface facility 48, e.g. a surface vessel, located at a sea surface 50. The riser 46 may be filled with an environmental fluid 52 which may comprise seawater or other riser fluids. A subsea landing string system 54 is deployed down through the riser 46 and into the blowout preventer 44. As with conventional subsea landing string systems, the illustrated subsea landing string system 54 may comprise various valves and latches which enable shutdown of well flow and separation of the landing string when the blowout preventer 44 is actuated in an emergency shutdown situation. The subsea landing string system 54 may be conveyed down to the wellhead installation 38 via an appropriate conveyance 56, e.g. coil tubing. In some embodiments, the subsea landing string system 54 may be used without riser 46 such that the subsea landing string system 54 is deployed through environmental fluid 52 in the form of open seawater.

Figure 2:
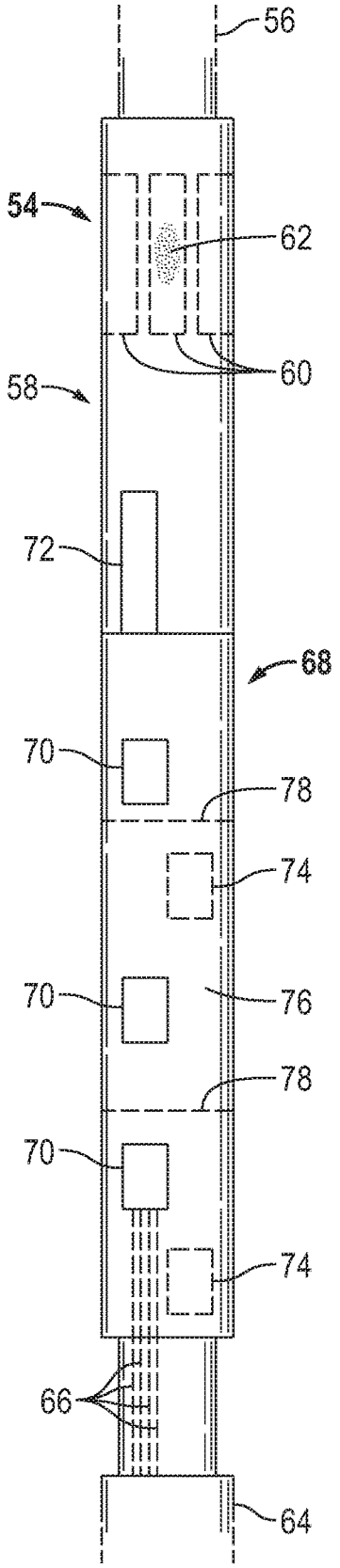
FIG. 2 is a schematic illustration of an example of a modular subsea landing string system, according to an embodiment of the disclosure.

Referring generally to FIG. 2, an embodiment of subsea landing string system 54 is illustrated. In this example, the subsea landing string system 54 may comprise an accumulator section 58 having a plurality of accumulators 60 containing hydraulic actuating fluid 62. However, the hydraulic actuating fluid 62 may be supplied from a surface facility, e.g. a surface vessel, via supply line or vent line (not shown). The hydraulic actuating fluid 62 is held under suitable pressure via, for example, accumulators 60 to enable actuation of tools 64 via flow of hydraulic fluid through corresponding hydraulic lines 66. It should be noted the tools 64 also may include the various conventional internal valves and latches within subsea landing string system 54 which may be operated to close off flow and to separate sections of the landing string system 54 in the event of an emergency shutdown. It should also be noted the conventional internal valves and latches have not been illustrated so as to facilitate explanation of the subsea landing string system 54.

According to the embodiment illustrated, the accumulator section 58 is connected to a hydraulic valve and manifold pod section 68. In some embodiments, the hydraulic valve and manifold pod section 68 also is the section which contains the conventional flow control valves and latches actuated in the event of an emergency shutdown. In some applications, the valves may be in a separate module, e.g. a separate module located below pod section 68. Additionally, the pod section 68 may contain at least one and often a plurality of manifolds 70 which may be individually controlled via a subsea electronic module (SEM) 72.

In this example, the subsea landing string system 54 is in the form of a modular landing string which allows individual manifolds 70 to be added or removed from corresponding manifold mounting sites 74 positioned along a landing string structure 76, e.g. a landing string chassis. In some embodiments, the landing string structure 76 also may be constructed via assembly of separable landing string sections 78 having corresponding manifold mounting sites 74. With either type of configuration, the number of manifolds 70 may be increased or decreased according to the parameters of a given subsea operation and according to the types and numbers of tools 64 utilized in the subsea operation.

Figure 3:
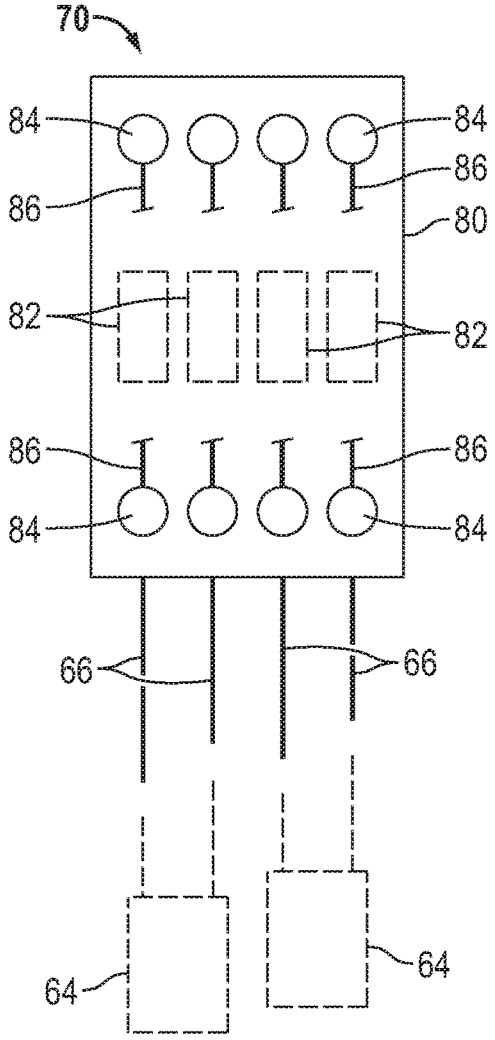
FIG. 3 is a schematic illustration of an example of a manifold which may be used in the modular subsea landing string system illustrated in FIG. 2, according to an embodiment of the disclosure.

Referring generally to FIG. 3, an embodiment of one of the manifolds 70 is illustrated. In this example, the manifold 70 comprises a manifold body 80 containing a plurality of directional control valves 82. The directional control valves 82 control the flow of hydraulic actuating fluid 62 along corresponding hydraulic control lines 66 and are actuated via corresponding solenoids 84. By way of example, two solenoids 84 may be associated with each directional control valve 82 so as to selectively open or close the corresponding directional control valve 82 according to commands provided to the solenoids 84.

Each solenoid 84 is coupled with at least one solenoid control line 86, e.g. at least one electrical control wire, by which the solenoid 84 receives commands from SEM 72. The at least one control line 86 may be routed through the manifold body 80 and sealed with respect to the environmental fluids 52 surrounding the manifold body 80. As described in greater detail below, the commands to each solenoid 84 may actually be received from a corresponding manifold electronics module which, in turn, receives commands from the SEM 72. According to those commands, the appropriate solenoids 84 are actuated to block or allow flow of actuating fluid 62 to and/or from the appropriate tool or tools 64. The tools 64 may include ball valves, slide valves, latches, and other tools disposed within the subsea landing string system 54 as well as tools external to the landing string system 54.

Figure 4:
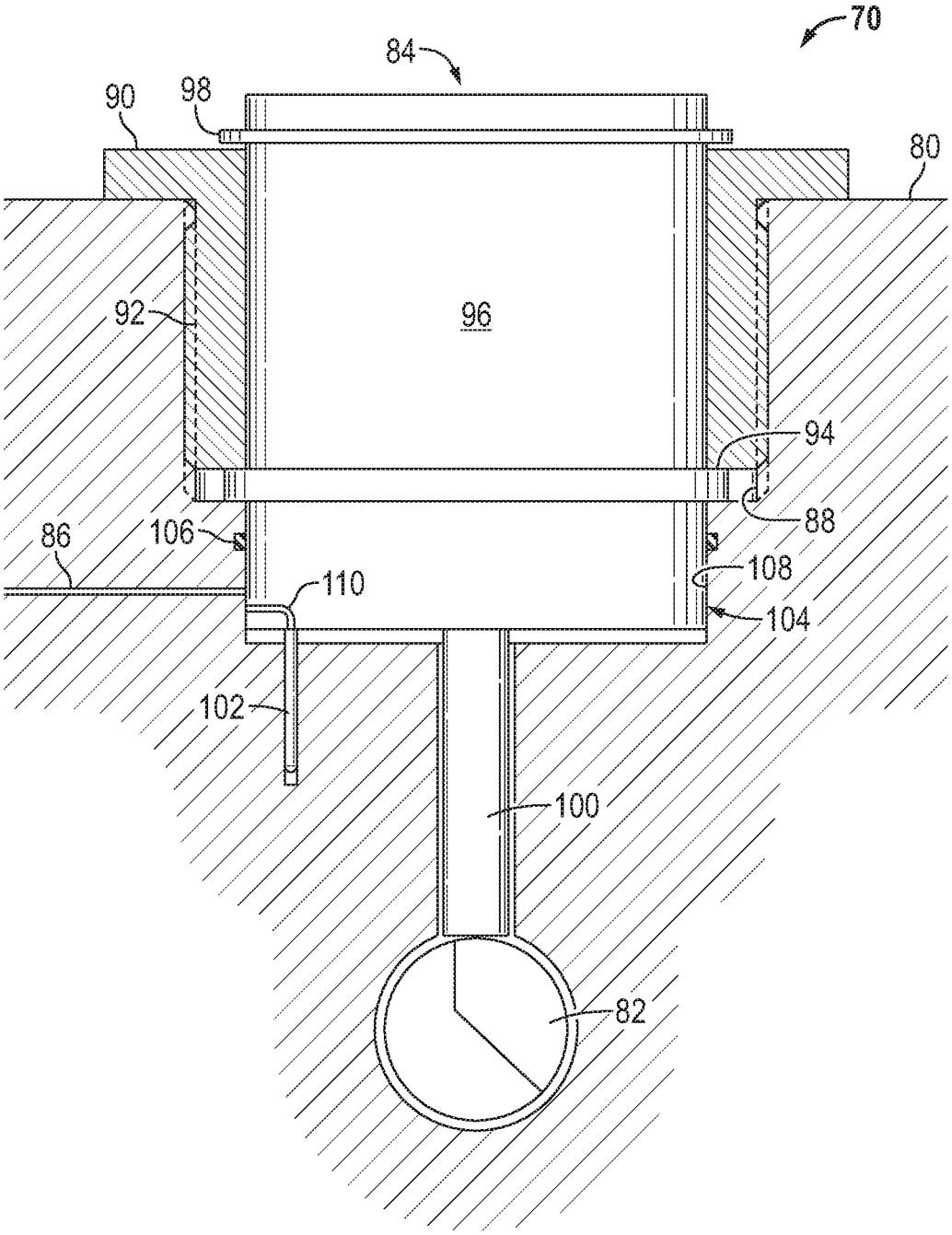
FIG. 4 is an illustration of an example of a solenoid mounted in a manifold and sealed therein to protect against exposure to environmental fluids, e.g. seawater, according to an embodiment of the disclosure.

Referring generally to FIG. 4, an embodiment of a solenoid 84 sealed within the manifold body 80 is illustrated. In this example, the solenoid 84 is disposed in a recess 88 formed within the manifold body 80 and secured therein via a nut 90. The nut 90 may be releasably secured to the manifold body 80 via, for example, a threaded region 92 or other suitable fastening technique. In the illustrated example, the nut 90 is threaded down against a shoulder 94 of a solenoid body 96 to press the solenoid 84 down into recess 88. A clip ring 98 or other suitable fastener may be coupled with solenoid 84 above nut 90 as illustrated.

The solenoid 84 also comprises a solenoid valve actuator body 100 which is positioned for engagement with the corresponding directional control valve 82 so as to shift the directional control valve 82 in a desired direction when the solenoid 84 is actuated. By way of example, the solenoid valve actuator body 100 may comprise or be in the form of a plunger moved linearly upon actuation of the solenoid 84 so as to rotate or otherwise actuate the corresponding directional control valve 82. According to an embodiment, a seal, e.g. a multi-seal, may be placed along valve actuator body 100. In some embodiments, the solenoid operated valves may be in the form of hydraulic pilots coupled with directional control valves 82. Additionally, the solenoid 84 may comprise a locating pin 102 or other suitable feature positioned to properly locate and orient the solenoid 84 when positioned in recess 88 of manifold body 80. In some embodiments, the locating pin 102 ensures proper valve port orientation of the corresponding directional control valve 82.

To avoid exposure to environmental fluid 52, the at least one solenoid control line 86, e.g. electrical wire, is routed through the manifold body 80, e.g. through a hole in the manifold body 80, and operatively connected to the solenoid 84 in a sealed region 104. The seals used to establish sealed region 104 and/or the multi-seal along actuator body 100 are formed from seal materials selected to survive in the fluid and pressure environments in which the manifold system is operated. By way of example, a seal 106, e.g. an O-ring seal or other suitable seal, may be positioned around the solenoid body 96 between the solenoid 84 and a surrounding recess surface 108 of manifold body 80 to form the seal region 104. Similar O-ring seals, other seals, or combinations of seals may be used along valve actuator body 100.

A solenoid ground wire 110 also may be connected with solenoid 84 within sealed region 104 and further connected to a suitable internal ground. For example, the solenoid ground wire 110 may be coupled with locating pin 102 (see FIG. 4), or routed to an external ground (see FIG. 5). In these embodiments, the wires, e.g. wires 86, 110, may be routed to an internal sealed cavity in the manifold 70 having a manifold electronic board as discussed in greater detail below.

Figure 5:
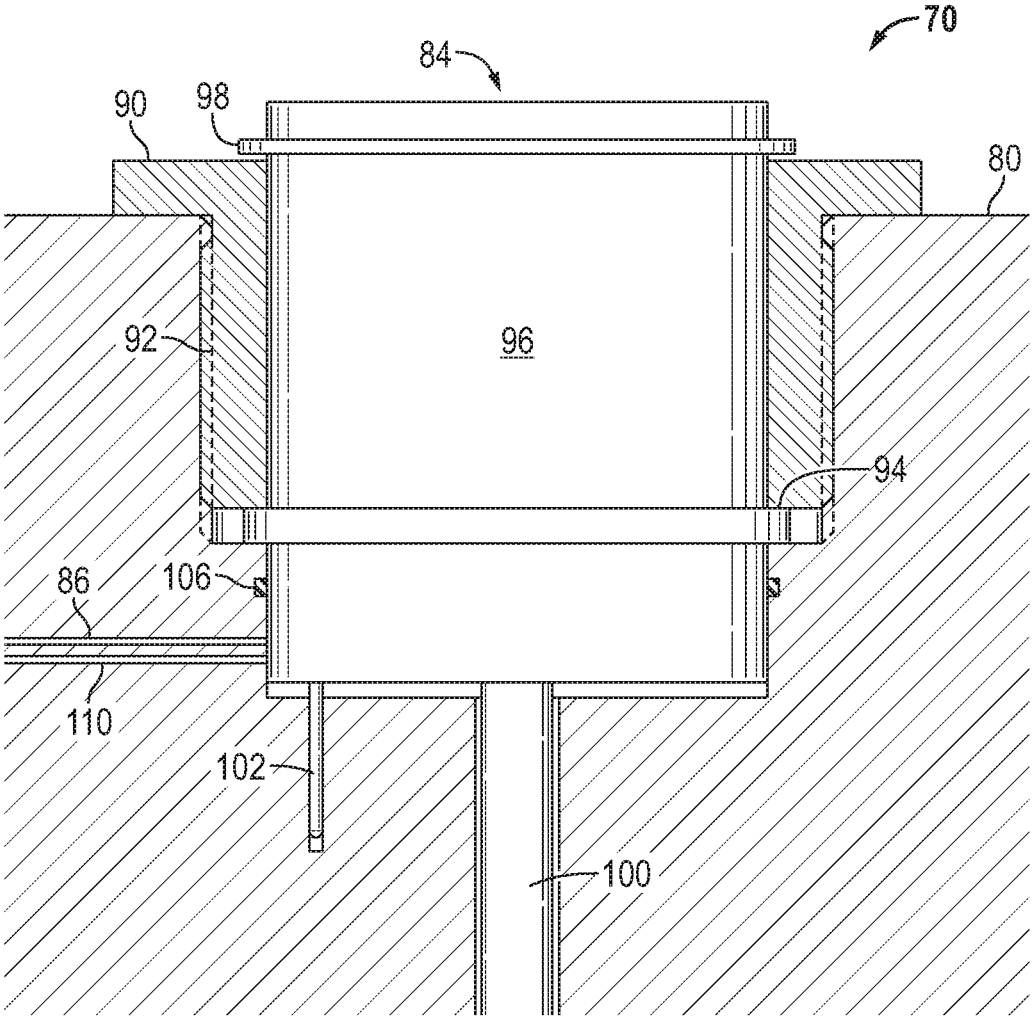
FIG. 5 is an illustration of another example of a solenoid mounted in a manifold, according to an embodiment of the disclosure.
Figure 6:
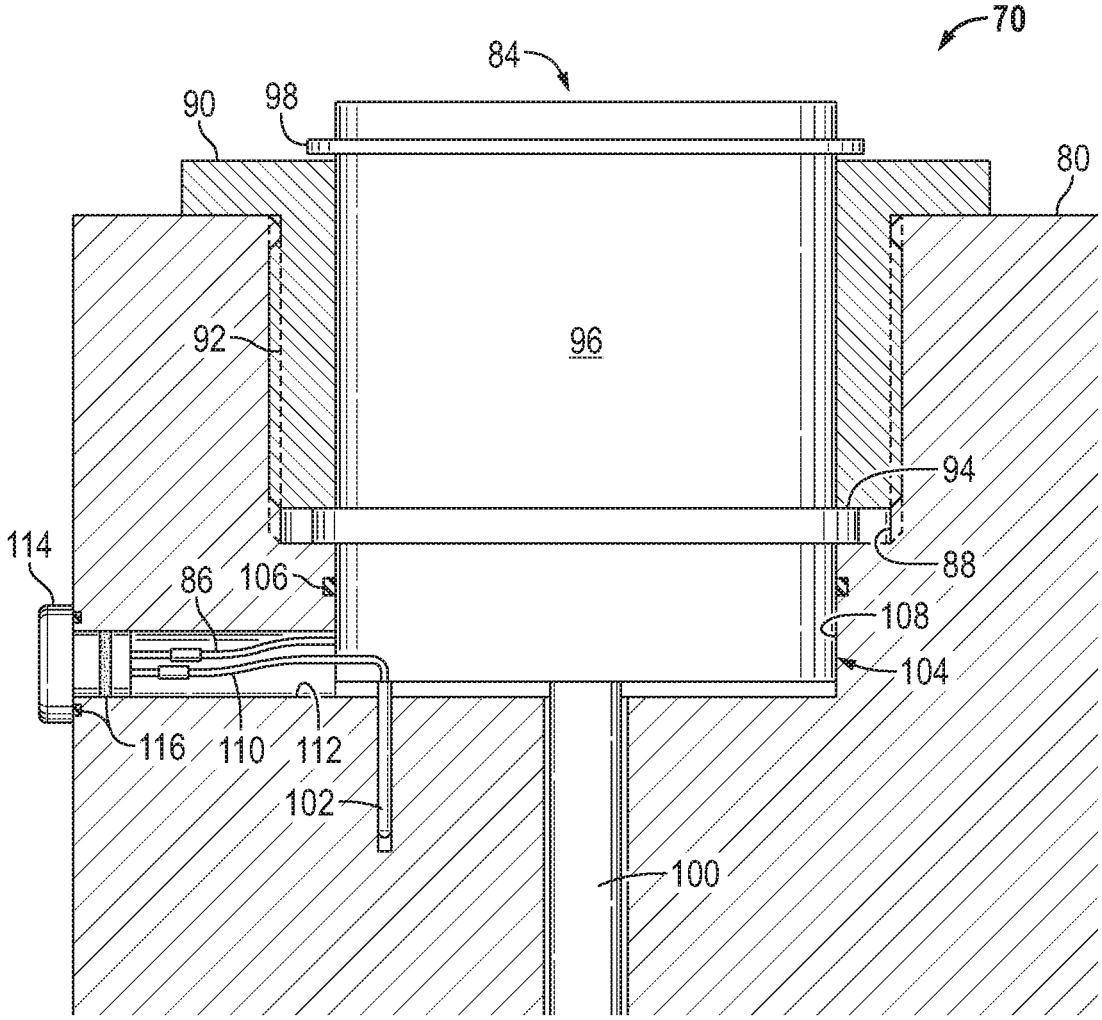
FIG. 6 is an illustration of another example of a solenoid mounted in a manifold, according to an embodiment of the disclosure.

Referring generally to FIG. 6, another embodiment of solenoid 84 is illustrated as positioned in manifold body 80 so as to form sealed region 104. In this example, the solenoid control line 86 extends from solenoid 84 and through manifold body 80 along the interior of a channel 112 located in the manifold body 80. The control line 86 extends through the channel 112 and is operatively connected with a subsea connector 114 which is sealed with respect to manifold body 80 and channel 112 via seals 116, e.g. O-ring seals or other suitable seals. The seals 116 ensure maintenance of sealed region 104 and protect the solenoid control lines 86, e.g. electrical wires, from exposure to environmental fluids such as seawater. It should be noted that a difference between the embodiment illustrated in FIG. 6 and those of FIGS. 4 and 5 is that wires coming out of the manifold 70 terminate at connector 114 (see FIG. 6) rather than being routed to, for example, an internal sealed cavity in the manifold 70 containing a manifold electronic board.

In this example, the solenoid ground wire 110 may be connected internally, e.g. connected with locating pin 102, or routed to subsea connector 114 for connection with a corresponding ground wire. This approach enables a reduction in the number of wires routed through the manifold 70. The manifold body 80 effectively serves as the ground via ground wire 110, and the manifold electronic board also may be grounded to manifold body 80 to complete the circuit. In some embodiments, more than one solenoid 84 may be interfaced with a single subsea connector 114 to reduce the number of parts.

Referring generally to FIGS. 7-10, additional embodiments of solenoid 84 are illustrated and show each solenoid 84 positioned in manifold body 80 to form sealed region 104. This type of embodiment enables operation with a reduced differential pressure acting along solenoid valve actuator body 100, e.g. across the multi-seal along the actuator body 100. In some embodiments, the solenoids 84 have two coils and thus four wires. The four wires may extend from one area or from different sealed areas. The use of different paths for the wires can facilitate routing of the wires inside the manifold 70. Additionally, the wires may be routed out of the solenoid 84 at various locations, such as the top or the bottom of the solenoid 84.

Figure 7:
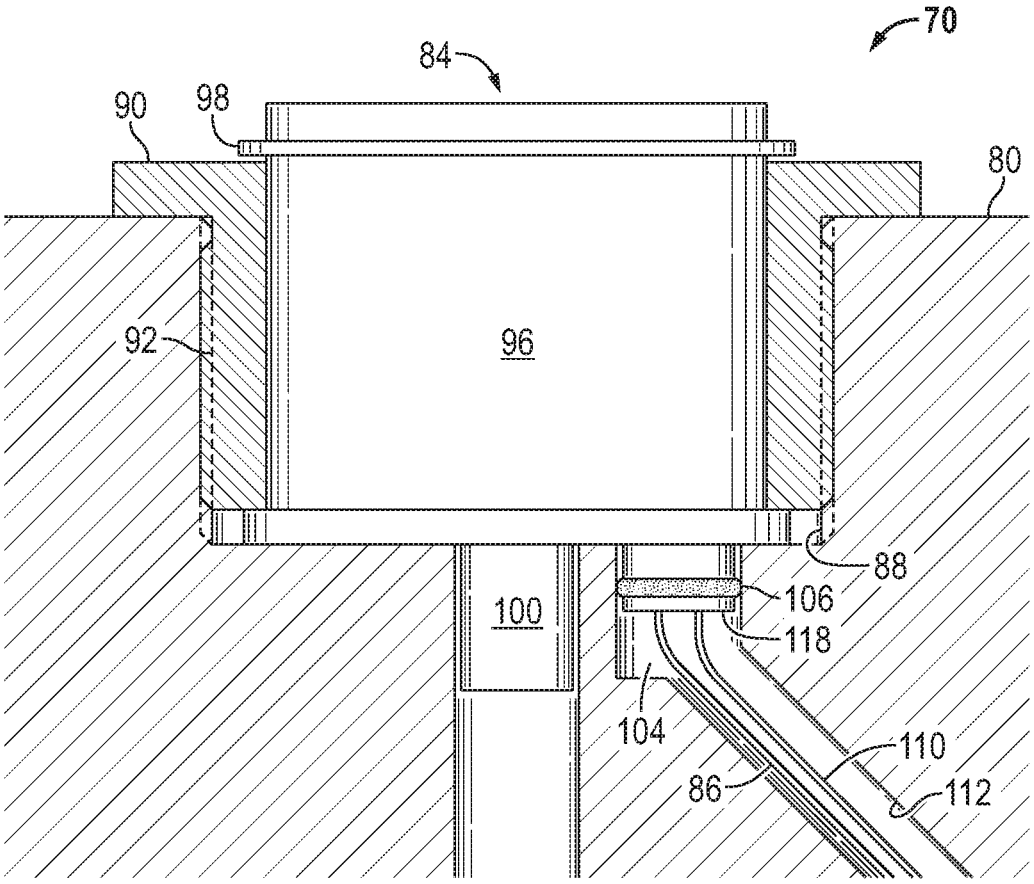
FIG. 7 is an illustration of another example of a solenoid mounted in a manifold, according to an embodiment of the disclosure.
Figure 8:
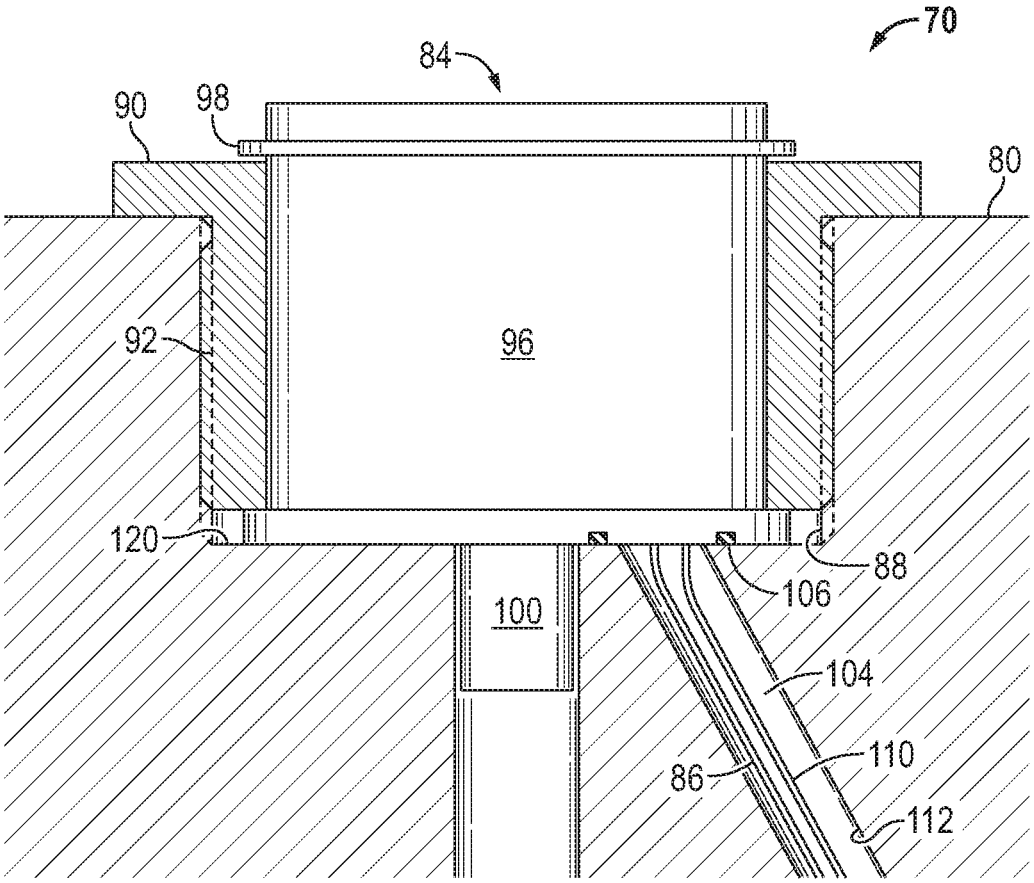
FIG. 8 is an illustration of another example of a solenoid mounted in a manifold, according to an embodiment of the disclosure.

In the embodiment illustrated in FIG. 7, for example, a single set of wires, e.g. control line 86 and ground wire 110, are routed through channel 112 disposed in manifold body 80. In this example, the sealed region 104 is established via seal 106 in the form of a bore seal disposed about an extension 118 of solenoid body 96. However, the sealed region 104 also may be established via seal 106 in the form of a face seal pressed between solenoid body 96 and a corresponding face 120 of recess 88, as illustrated in FIG. 8.

Figure 9:
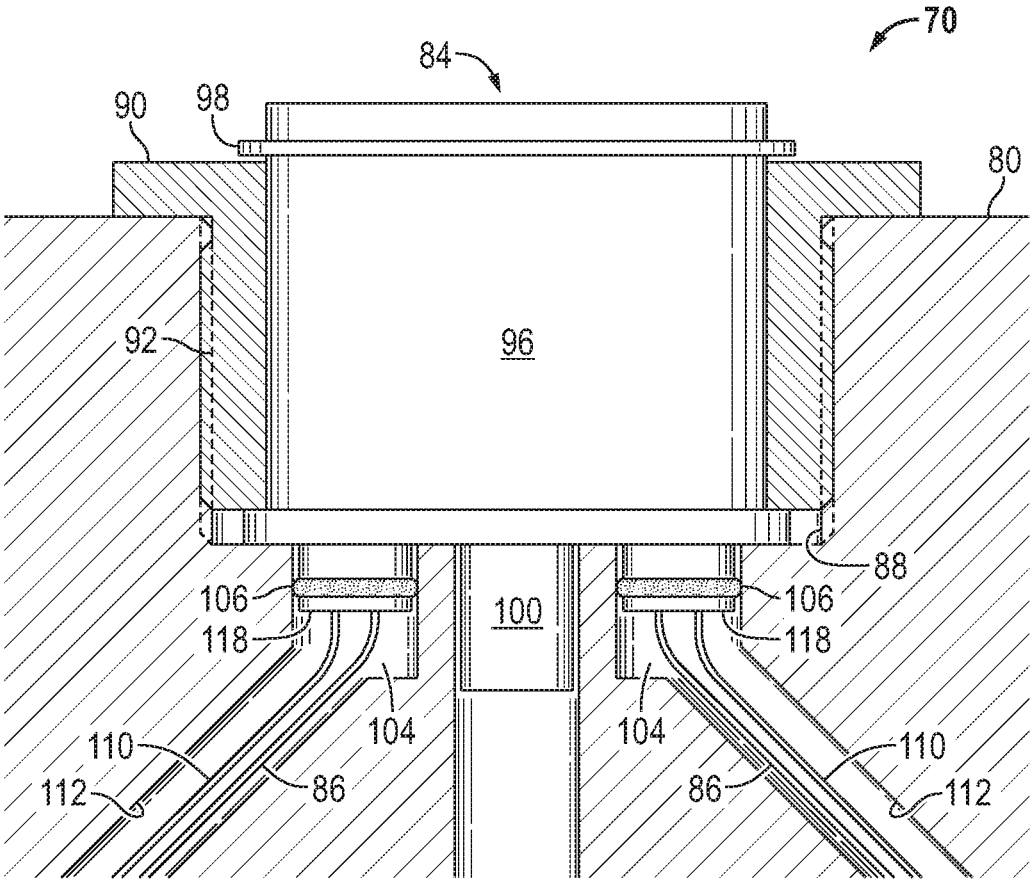
FIG. 9 is an illustration of another example of a solenoid mounted in a manifold, according to an embodiment of the disclosure.
Figure 10:
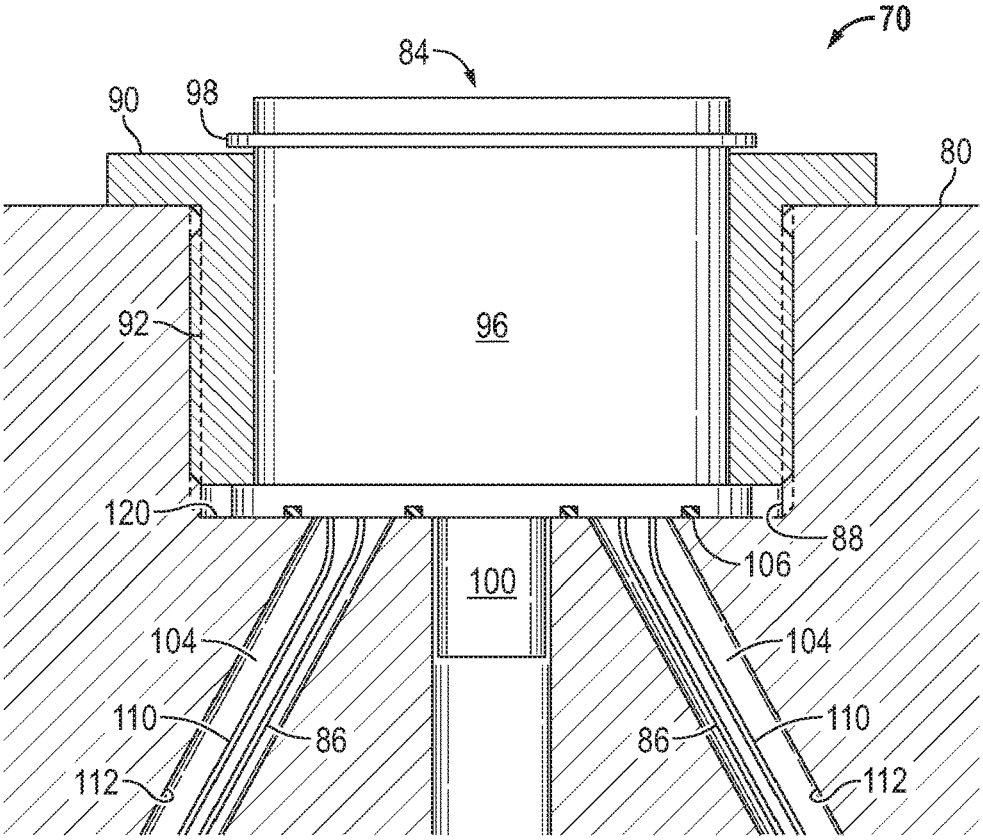
FIG. 10 is an illustration of another example of a solenoid mounted in a manifold, according to an embodiment of the disclosure.

In other embodiments, each solenoid 84 may be connected with a plurality of wire sets, e.g. two sets of solenoid control lines 86 and ground wires 110, as illustrated in FIGS. 9 and 10. In the embodiment of FIG. 9, for example, separate wire sets are routed to the corresponding solenoid 84 at a pair of the solenoid body extensions 118. A pair of the seals 106 in the form of bore seals may be used to establish the sealed region 104. As illustrated in FIG. 10, a pair of seals 106 in the form of face seals also may be used to establish the sealed region 104. These and other configurations may be used to establish the desired sealed region 104 at a single location or a plurality of locations so as to protect the solenoid control lines 86 and corresponding connections, e.g. electrical connections, from the environmental fluids 52.

Figure 11:
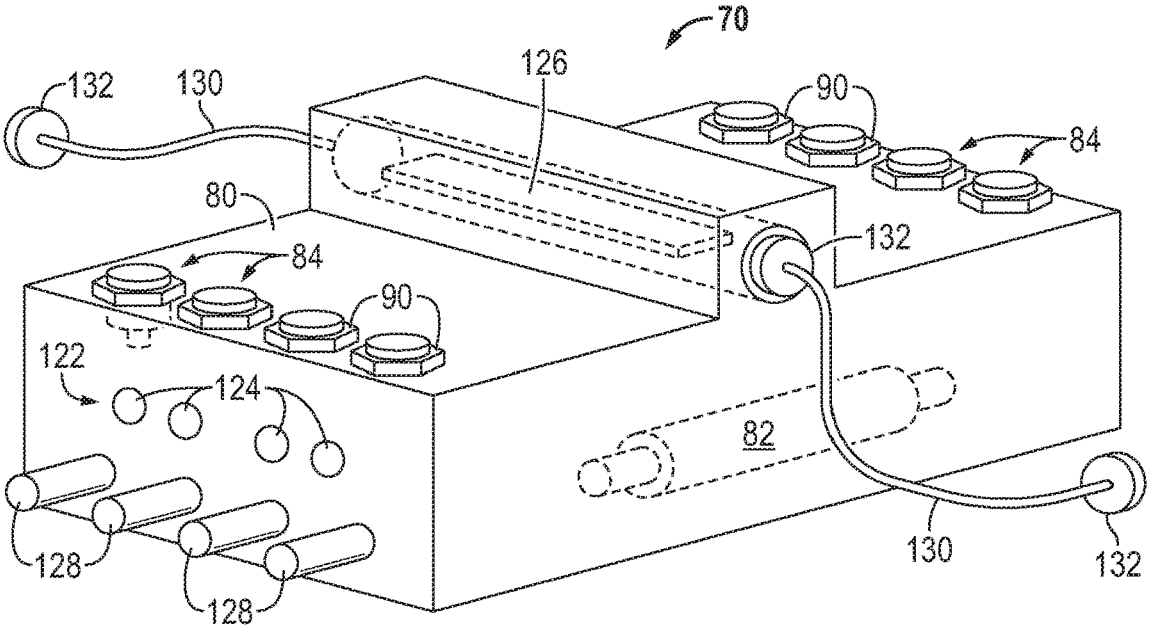
FIG. 11 is an illustration of an example of a subsea manifold, according to an embodiment of the disclosure.

Referring generally to FIG. 11, an embodiment of one of the manifolds 70 is illustrated. In this example, manifold 70 comprises a plurality of the solenoids 84 which are received in manifold body 80. The solenoids 84 may be sealed therein via seals 106 according to, for example, one of the embodiments described above. Pairs of solenoids 84 work in cooperation with individual directional control valves 82 to control flow of hydraulic actuating fluid 62 through a flow network 122 and out through appropriate ports 124 to selected tools 64.

Actuation of selected, individual solenoids 84 may be controlled by a manifold electronics module 126 which may be in the form of a printed circuit board or other suitable manifold electronic board. In this example, the manifold electronics module 126 is disposed within manifold body 80 and sealed therewithin. The solenoid control lines 86, e.g. electrical wires, may be routed from each solenoid 84 and each corresponding sealed region 104 to the manifold electronics module 126 via channels 112 or via other suitable methods.

In some embodiments, the manifolds 70 also may comprise sensors 128, e.g. pressure gauges, to monitor desired functions. For example, the sensors/pressure gauges 128 may be positioned to monitor pressures along channels within flow network 122 so as to verify actuation of specific directional control valves 82 via the corresponding solenoids 84. It should be noted the sensors 128 also can be part of the manifold electronics module 126. The data from sensors 128 may be provided to manifold electronics module 126 via corresponding signal lines (similar to solenoid control lines 86) which are sealed within the body 80 of manifold 70. Furthermore, the manifold electronics module 126 may be placed in communication with the subsea electronics module 72 and/or other manifolds 70 via subsea tolerant cables 130. The subsea tolerant cables 130 may comprise sealing connectors 132, e.g. dry mate or wet mate connectors, operatively plugged into the subsea electronics module 72 and/or cooperating manifolds 70.

Figure 12:
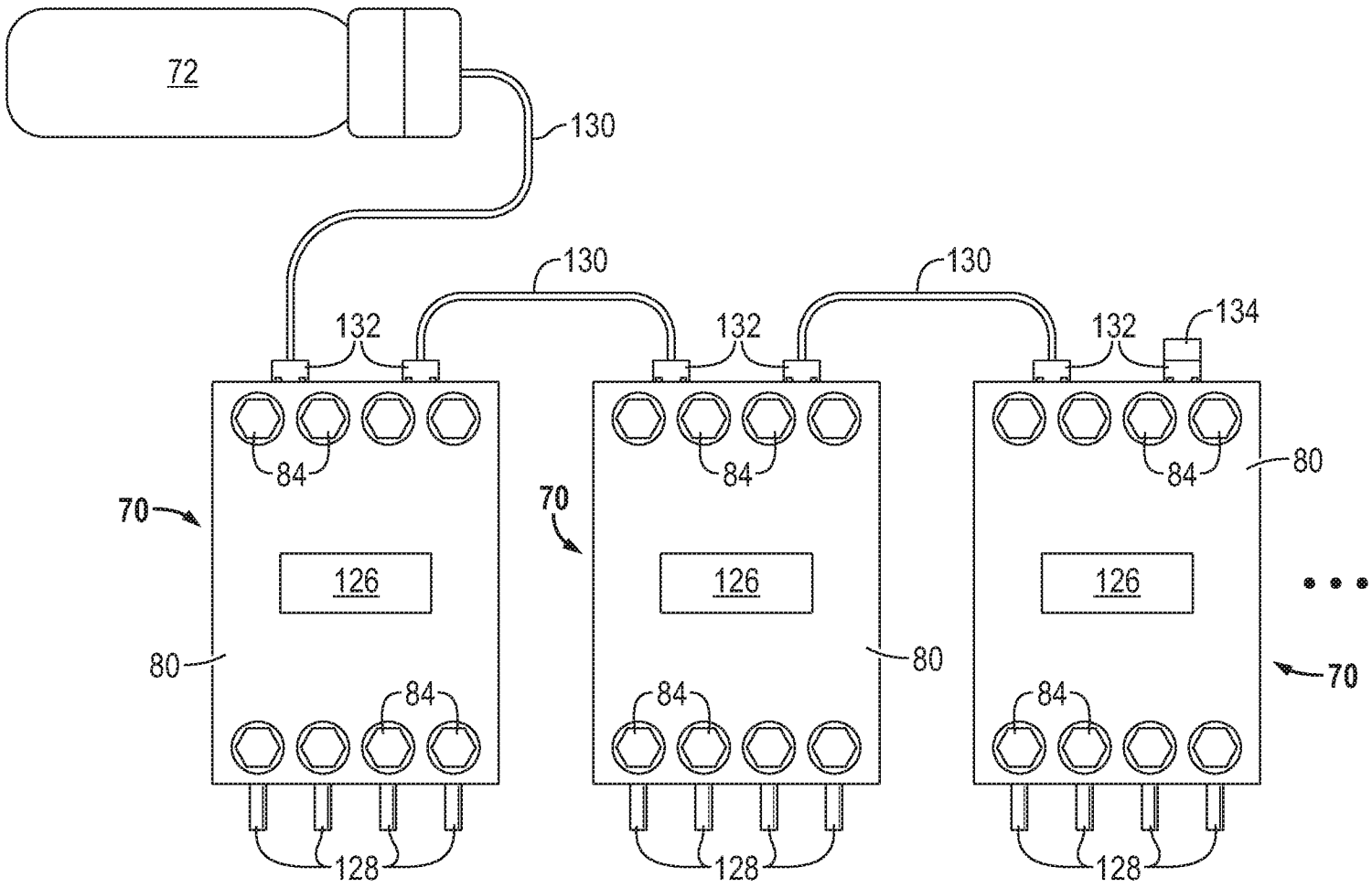
FIG. 12 is a schematic illustration of an example of a plurality of modular manifolds coupled with a subsea electronic module, according to an embodiment of the disclosure.

As illustrated in FIG. 12, a plurality of the manifolds 70 may be placed in communication with the subsea electronics module 72 via serial connection of the subsea electronics module 72 and manifolds 70 by a plurality of the subsea tolerant cables 130. In the specific example illustrated, the final connector 132 is capped via a sealed cap 134 to protect the solenoids 84 and other internal components of the final manifold 70 from exposure to seawater and/or other environmental fluids 52.

Figure 13:
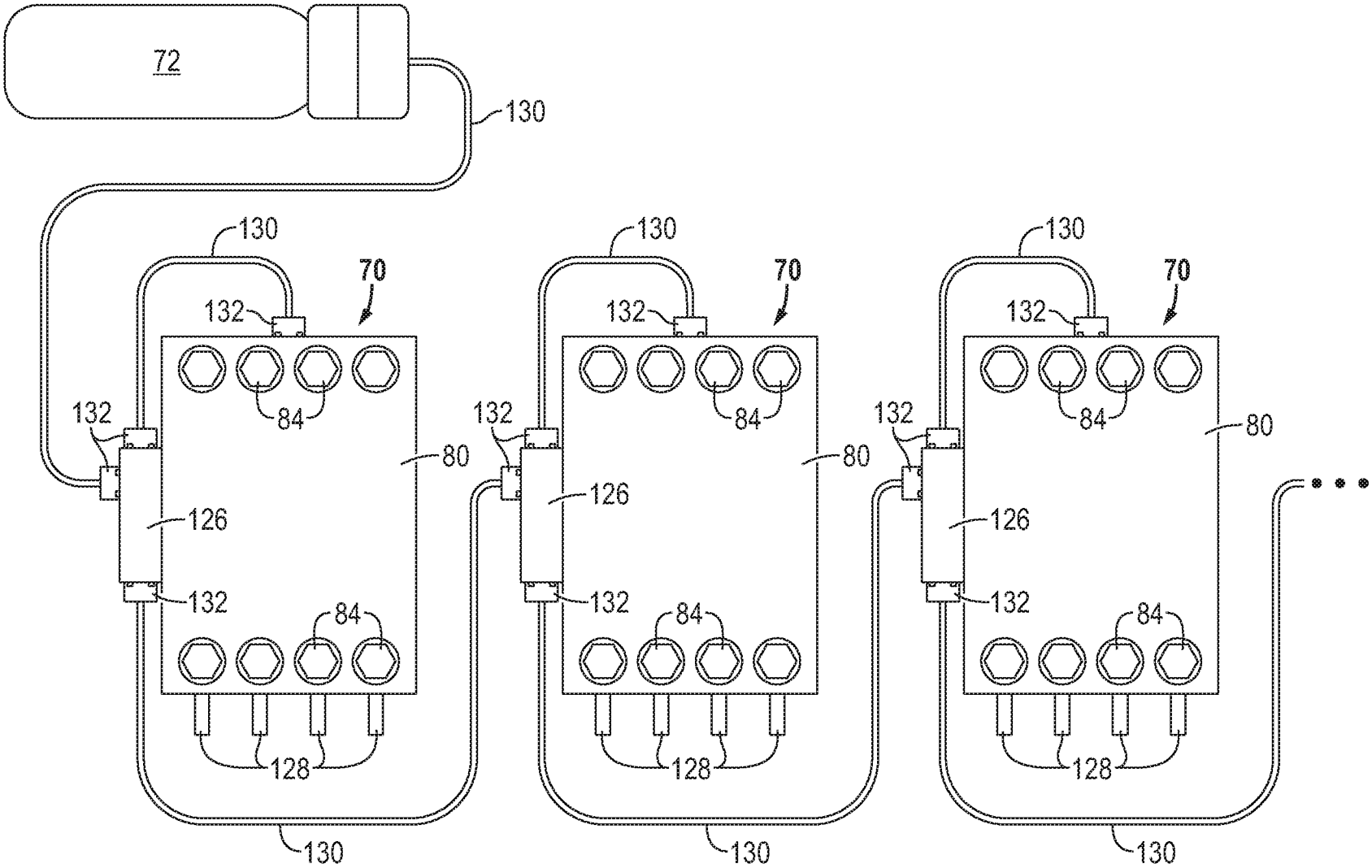
FIG. 13 is a schematic illustration of another example of a plurality of modular manifolds coupled with a subsea electronic module, according to an embodiment of the disclosure.

Referring generally to FIG. 13, another manifold architecture is illustrated in which the manifold electronics module 126 associated with each corresponding manifold 70 is located externally of the manifold body 80. In this type of embodiment, manifold electronics modules 126 are individually coupled with the solenoids 84 (as well as other associated components of within the corresponding manifold body 80) via subsea tolerant cables 130. In some embodiments, the manifold electronics module 126 may be coupled to manifold body 80 via a direct connector-to-connector mounting. Additionally, the manifold electronics modules 126 may be coupled sequentially with each other and with the subsea electronic module 72 via subsea tolerant cables 130.

Figure 14:
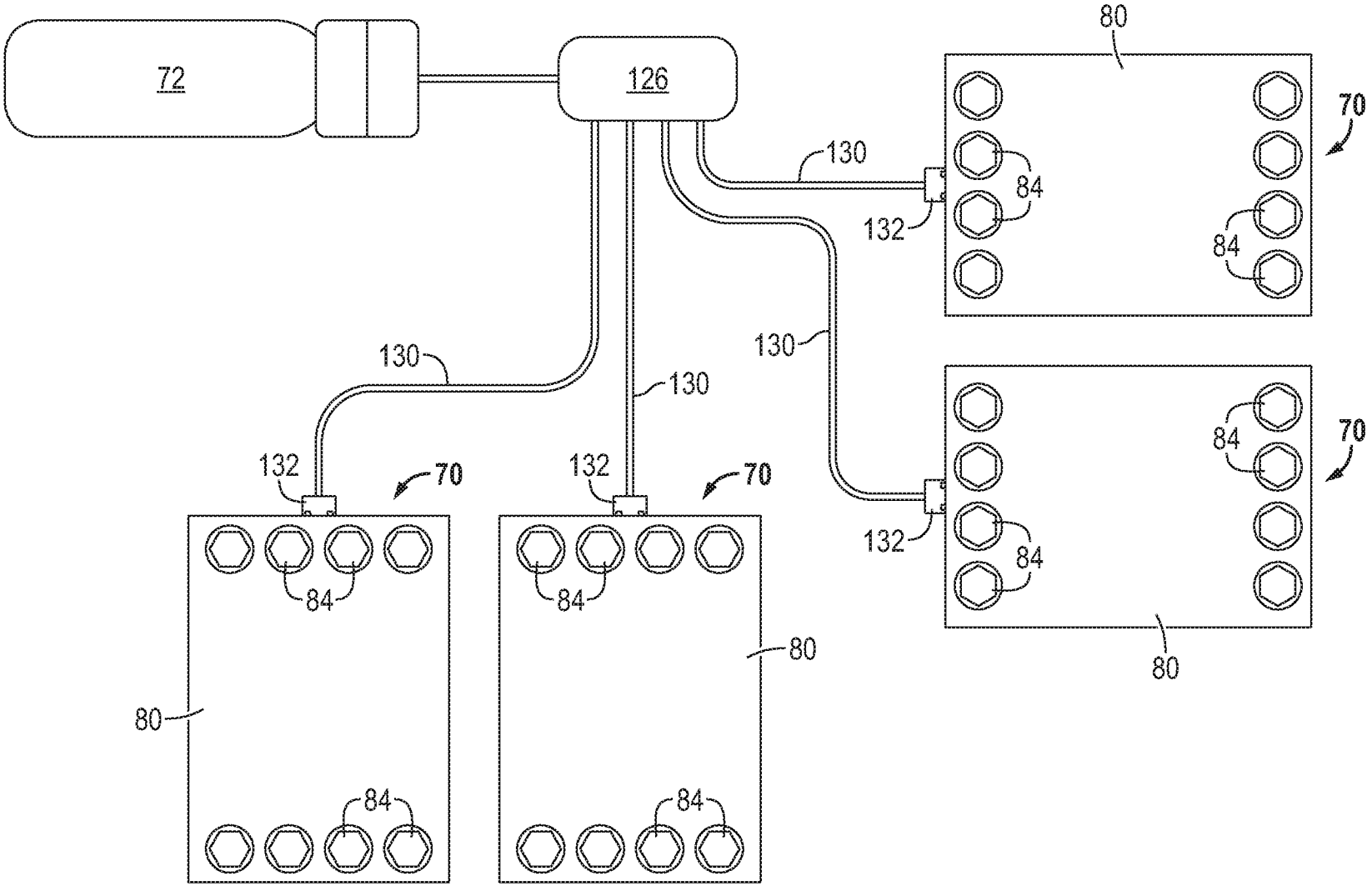
FIG. 14 is a schematic illustration of another example of a plurality of modular manifolds coupled with a subsea electronic module, according to an embodiment of the disclosure.

In some embodiments, an individual manifold electronics module 126 may provide instructions for a plurality of manifolds 70. As illustrated in FIG. 14, for example, an individual manifold electronics module 126 may be connected to subsea electronics module 72 and to a plurality of manifolds 70 via a multi-segment subsea tolerant cable 130.

Figure 15:
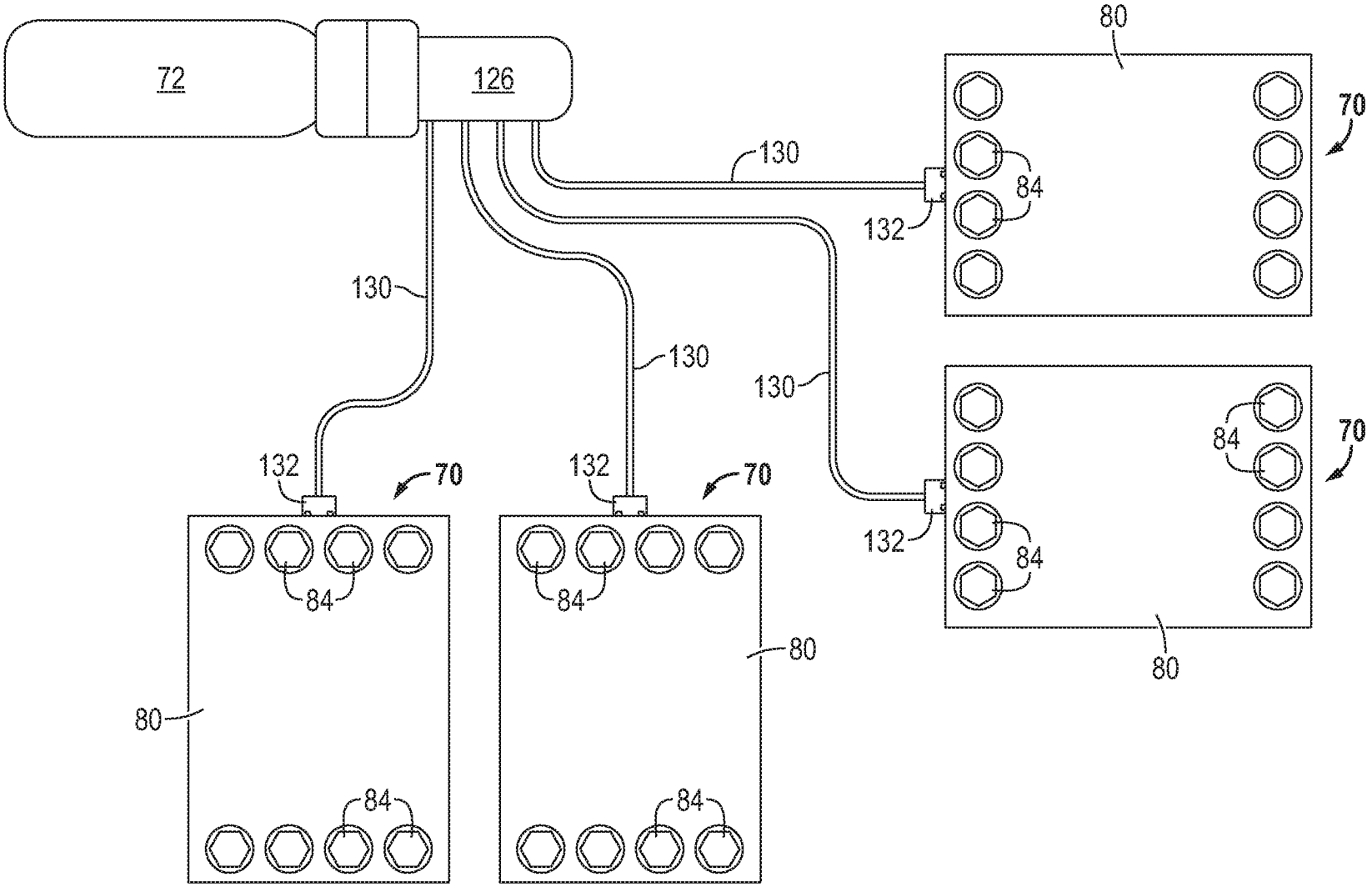
FIG. 15 is a schematic illustration of another example of a plurality of modular manifolds coupled with a subsea electronic module, according to an embodiment of the disclosure.
Figure 16:
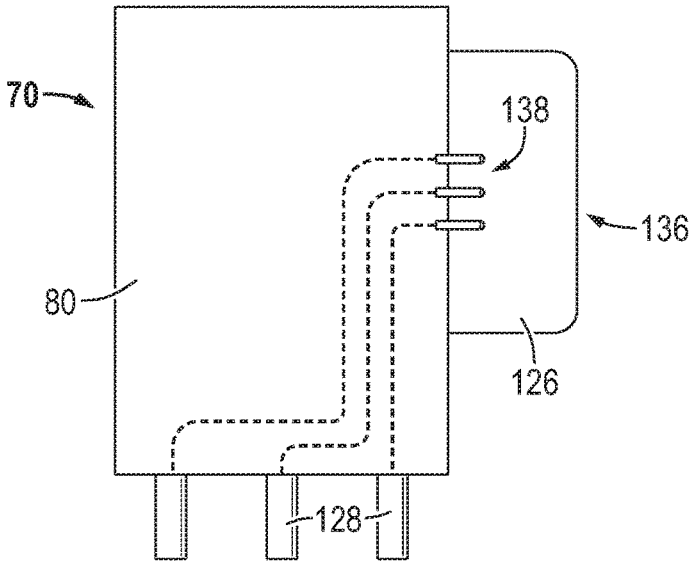
FIG. 16 is a schematic illustration of an example of a modular manifold for subsea operations, according to an embodiment of the disclosure.

According to another embodiment, a group of manifolds 70 may be wired to the subsea electronics module 72 via subsea tolerant cables 130, as illustrated in FIG. 15. For example, the manifold electronics modules 126 of the group of manifolds 70 may be wired to the subsea electronics module 72 via the subsea tolerant cables 130. Depending on the application, various other types of manifold configurations may be utilized. As illustrated in FIG. 16, for example, the manifold electronics module 126 may be contained in a separate module 136 which is pluggable into operative engagement with manifold body 80 via a suitable connector 138, such as a dry mate or wet mate connector. However, the manifold electronics module 126 itself may be constructed as a module having a housing designed for operation at a desired pressure or to withstand a predetermined pressure.

Figure 17:
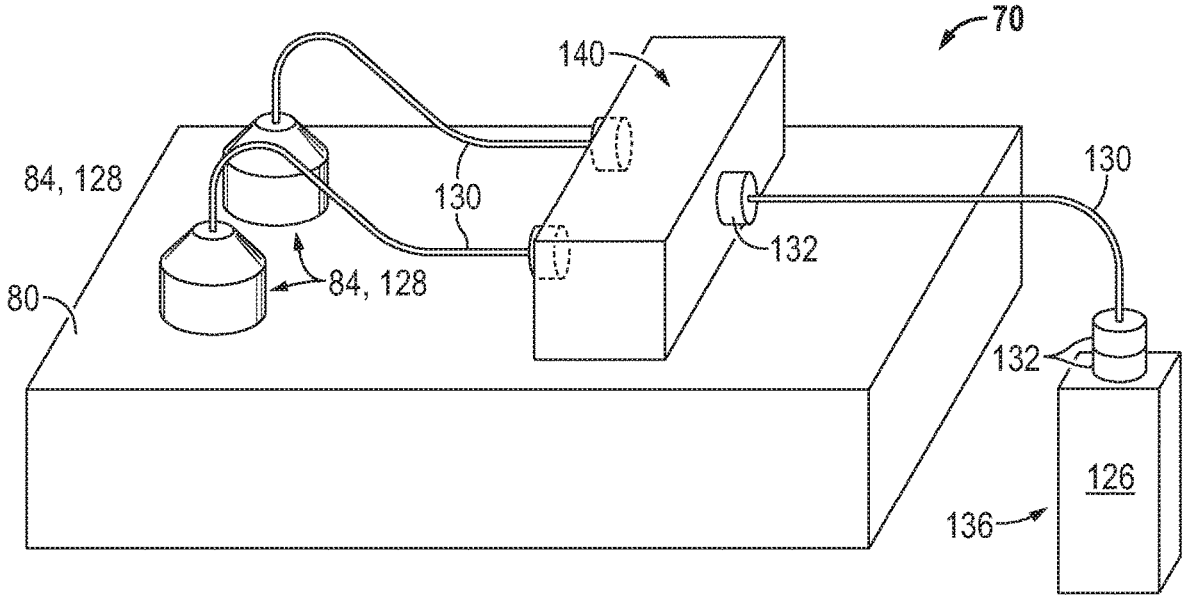
FIG. 17 is a schematic illustration of an example of another modular manifold, according to an embodiment of the disclosure.

In another example, the manifold electronics module 126 itself or the separate module 136 containing manifold electronics module 126 may be joined with a junction box 140 located on manifold body 80, as illustrated in FIG. 17. The module 136 may be coupled with junction box 140 via a subsea tolerant cable 130 or other suitable signal transfer system. The junction box 140 also may be used for coupling with other components, e.g. the illustrated sensors 128 or solenoids 84, via suitable subsea tolerant cables/connectors 130. This approach provides a technique which reduces or avoids internal wiring by using, for example, overmoulded or other types of subsea tolerant cables. The solenoids 84 and/or sensors 128 may be connected to the manifold electronics module 126 directly or via junction box 140. Additionally, the junction box 140 may be a printed circuit board with wire connectors. It should be noted the subsea tolerant cables 130 described herein may be constructed in many configurations with a variety of cables, connectors, and other features to enable transfer of electric signals and/or other types of signals between the desired components.

Figure 18:
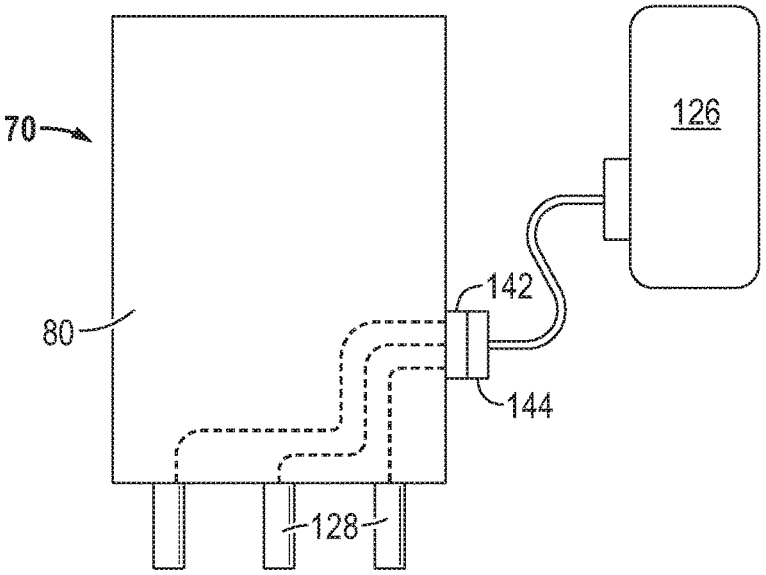
FIG. 18 is a schematic illustration of an example of another modular manifold, according to an embodiment of the disclosure.

Another embodiment of manifold 70 is illustrated in FIG. 18 and is somewhat similar to the embodiment described above with reference to FIG. 16. However, the sensors 128 and/or solenoids 84 are wired to a subsea tolerant connector 142. The connector 142 may be releasably coupled with a corresponding connector 144 wired to the manifold electronics module 126. By way of example, the connectors 142, 144 may be subsea tolerant dry mate or wet mate connectors.

Figure 19:
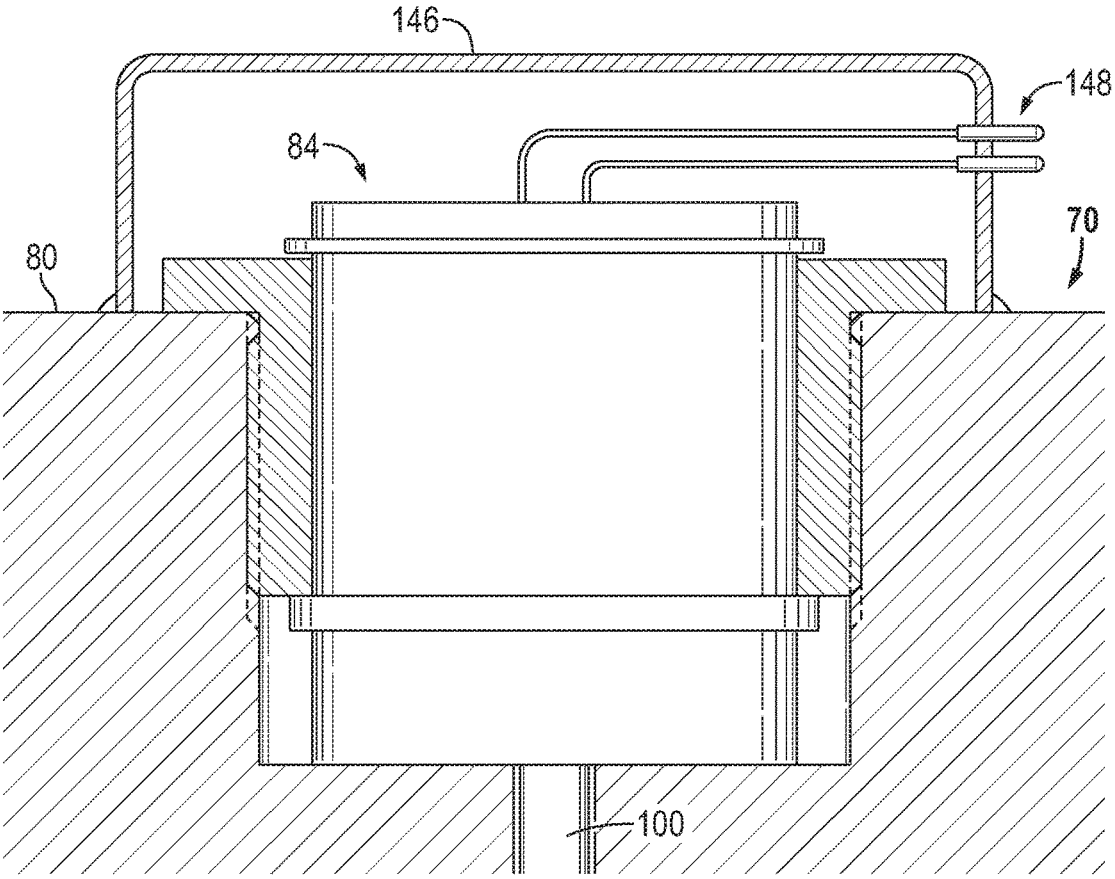
FIG. 19 is a schematic illustration of an example of another modular manifold, according to an embodiment of the disclosure.

Referring generally to FIG. 19, another embodiment of manifold 70 is illustrated as having additional termination protection. In this example, a cap 146, e.g. a metal cap, may be positioned over the solenoid 84 (or sensor 128) and sealed to the manifold body 80 via a weld or other suitable sealing mechanism. The solenoid 84 (or sensor 128) may be wired to terminations 148 extending through the cap 146 and sealed thereto. By way of example, the terminations 148 may be connected to the corresponding manifold electronics module 126. In some embodiments, the interior of cap 146 may be filled with a desired fluid, such as air, nitrogen, dielectric fluid, or other suitable fluid for a given operation.

Depending on the specifics of a given use, the shape, size, and features of subsea landing string system 54 as well as the overall subsea system 30 may be adjusted. For example, different numbers of manifolds 70 and different numbers of hydraulic control lines 66 may be used in a given system according to the parameters of the hydrocarbon production operation or other subsea operation. Additionally, the types of manifold attachment mechanisms, manifold electronic modules, SEMs, valves, sensors, and other components may be selected according to the operational parameters. Furthermore, different numbers of solenoids and corresponding directional control valves may be used in each manifold and the flow circuitry for controlling flow to selected hydraulic control lines 66 may have various configurations.

Similarly, the flow paths for hydraulic actuating fluid 62 may be formed by various bores, pipes, conduits, and other flow channels coupled by various hydraulic connection mechanisms. Examples of such hydraulic connection mechanisms include seal stab connectors or JIC (Joint Industry Council) connectors having seals, e.g. O-rings, made from suitable materials. The hydraulic connection mechanisms also may comprise metal-to-metal seals or combination seals combining elastomers and metals.

Additionally, the modularity of the system enables mounting of manifolds 70 in other locations. For example, manifolds may be mounted on both the subsea landing string system 54 and on other components of the overall landing string. Similarly, the subsea landing string system 54 may be updated by adding and/or removing certain manifolds to accommodate production changes, operational changes, and/or different subsequent uses of the system. Individual manifolds 70 may have different configurations relative to other manifolds 70 used in cooperation with the subsea landing string system 54. Additionally, various types of seals and seal chambers may be employed to ensure continued protection of the electrical wires or other solenoid control lines while the manifolds 70 are exposed to environmental fluids such as seawater.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well operation, comprising:

a subsea landing string system comprising a plurality of manifolds exposed to environmental fluids, the manifolds being modular to enable mounting and removal of selected manifolds with respect to manifold mounting sites disposed along the subsea landing string, the number of manifolds being selectable according to the parameters of a given operation, each manifold comprising a manifold body containing a plurality of directional control valves selectively controlled via solenoids, each solenoid being electrically coupled with a solenoid control line within a sealed region, the solenoid control line being routed through the manifold body and into the sealed region, the sealed region being established by at least one seal positioned to protect the sealed region with respect to environmental fluids surrounding the manifold body, each manifold being removably mounted to a corresponding manifold mounting site while remaining exposed to the environmental fluids without the protection of a compensated enclosure.

2. The system as recited in claim 1, wherein the subsea landing string system further comprises a subsea electronics module coupled in communication with the plurality of manifolds.

3. The system as recited in claim 2, wherein each manifold comprises a manifold electronics module to receive commands from the subsea electronics module, the manifold electronics module being operatively connected to the solenoids of the manifold via the solenoid control lines.

4. The system as recited in claim 3, wherein each manifold electronics module is sealed within the manifold body of the manifold.

5. The system as recited in claim 3, wherein each manifold electronics module is coupled to the subsea electronics module by a subsea tolerant cable.

6. The system as recited in claim 1, further comprising a blowout preventer, the subsea landing string system being landed within the blowout preventer.

7. The system as recited in claim 6, further comprising a riser coupled between the blowout preventer and a surface facility.

8. The system as recited in claim 7, wherein the manifolds are located within the riser.

9. The system as recited in claim 3, wherein the manifold electronics module is separate from the manifold body.

10. A method, comprising:

deploying a subsea landing string system down through a riser and into a blowout preventer;

providing manifolds which are modular to enable removable mounting of the manifolds at selected manifold mounting sites along the subsea landing string;

locating directional control valves and corresponding solenoids in manifolds of the subsea landing string system such that the manifolds, as well as an external surface of the corresponding solenoids, are exposed to surrounding environmental fluid without the protection of compensated enclosures;

controlling the corresponding solenoids via signals provided through electrical control lines;

protecting the electrical control lines from the surrounding environmental fluid by connecting the electrical control lines to the corresponding solenoids within sealed regions located adjacent the corresponding solenoids; and controlling hydraulic actuation of at least one tool via operation of selected directional control valves via the corresponding solenoids.

11. The method as recited in claim 10, further comprising changing the number of manifolds along the subsea landing string system according to the parameters of a given subsea operation.

12. The method as recited in claim 10, wherein controlling comprises utilizing a subsea electronics module to provide command signals for controlling operation of specific solenoids.

13. The method as recited in claim 12, further comprising forming the sealed regions via O-ring seals.

14. The method as recited in claim 13, wherein protecting comprises routing the electrical control lines through manifold bodies and positioning the seals within the manifold bodies to isolate the solenoid control lines.

15. The method as recited in claim 14, further comprising providing command signals through the electrical control lines of each manifold via a manifold electronics module coupled with the subsea electronics module via a subsea tolerant cable.

16. The method as recited in claim 15, further comprising sealing the manifold electronics module of each manifold within the manifold body.

17. A system, comprising:

a modular subsea landing string having a plurality of manifold mounting sites to receive a selected number of manifolds for controlling flow of actuating fluid, each manifold being removably mounted along the modular subsea landing string and remaining without protection from a compensated enclosure during operation such that external surfaces of the plurality of manifolds are contacted by environmental fluid, the modular subsea landing string further having a landing string structure enabling the mounting of additional manifolds at manifold mounting sites, disposed along an exterior of the landing string, the number of manifolds being selected according to the parameters of a subsea operation.

18. The system as recited in claim 17, wherein each manifold comprises at least one directional control valve controlled by a plurality of solenoids actuated via electrical signals provided via an electrical solenoid control line.

19. The system as recited in claim 18, wherein the electrical solenoid control line is sealed within a manifold body to prevent exposure to surrounding environmental fluids.

20. The system as recited in claim 19, wherein each manifold is in hydraulic communication with a hydraulically actuated tool.

* * * * *